United States Patent [19]

Luce et al.

[11] 4,027,569

[45] June 7, 1977

[54] KEYBOARD FOR AN ELECTRONIC MUSICAL INSTRUMENT EMPLOYING VARIABLE CAPACITORS

[75] Inventors: David A. Luce, Clarence Center; Anthony Marchese, Cheektowaga, both of N.Y.

[73] Assignee: Norlin Music, Inc., Lincolnwood, Ill.

[22] Filed: June 19, 1975

[21] Appl. No.: 588,320

[52] U.S. Cl. ..... 84/1.1; 84/1.27; 84/423; 84/433; 84/DIG. 7; 200/DIG. 1; 340/365 C; 361/300

[51] Int. Cl.[2] ..... G10H 1/02

[58] Field of Search ..... 84/1.01, 1.04, 1.08–1.1, 84/1.27, DIG. 7, 423, 433; 200/5 A, 52 R, DIG. 1; 317/249 R, 255, DIG. 2; 340/365 C

[56] References Cited

UNITED STATES PATENTS

| | | | |
|---|---|---|---|
| 2,873,637 | 2/1959 | Herold | 84/1.04 |
| 2,878,708 | 3/1959 | Hanert | 84/1.08 |
| 3,643,041 | 2/1972 | Jackson | 200/5 A |
| 3,715,447 | 2/1973 | Ohno | 84/DIG. 7 |

OTHER PUBLICATIONS

William H. Hayt, Jr., Engineering Electromagnetics, Second Edition, Copywright 1958, 1967 by McGraw-Hill, Inc., pp. 118–133.

*Primary Examiner*—Stanley J. Witkowski
*Attorney, Agent, or Firm*—Hill, Gross, Simpson, Van Santen, Steadman, Chiara & Simpson

[57] ABSTRACT

A keyboard of an electronic musical instrument incorporates a plurality of variable capacitors, one for each key, with one conductor of each capacitor being connected for movement with an individual key of the keyboard toward and away from the other conductor, so as to vary the capacitance of the capacitor in accordance with the force with which the key is depressed.

17 Claims, 9 Drawing Figures

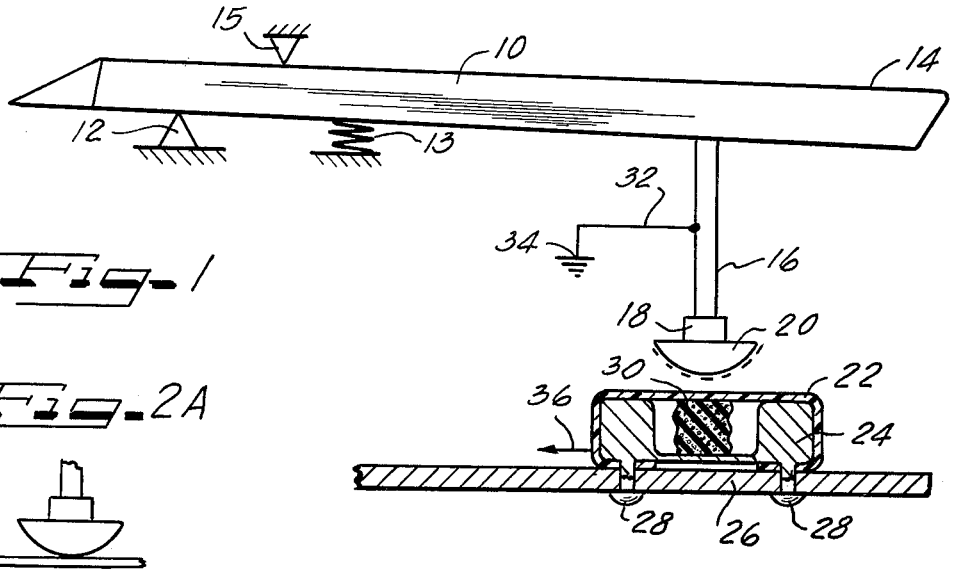
Fig. 1
Fig. 2A
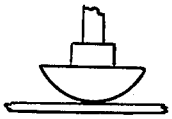
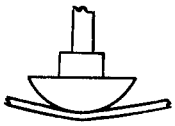
Fig. 2B
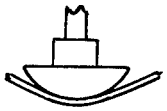
Fig. 2C
Fig. 4A
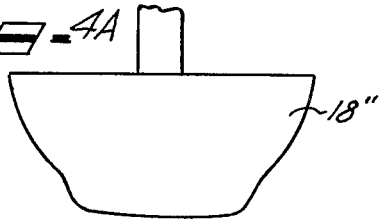
Fig. 4B
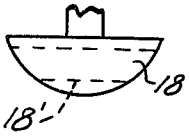
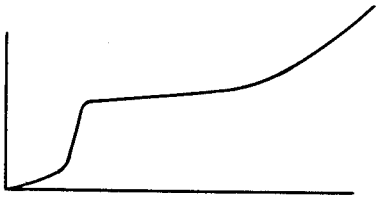
Fig. 5A
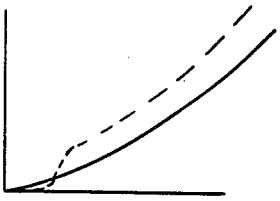
Fig. 5B
Fig. 3
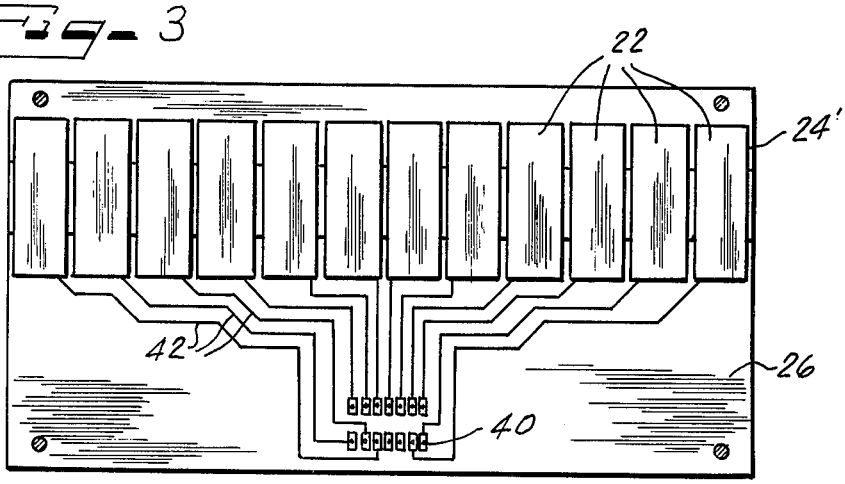

KEYBOARD FOR AN ELECTRONIC MUSICAL INSTRUMENT EMPLOYING VARIABLE CAPACITORS

BACKGROUND OF THE INVENTION

1. Field of the Invention

The present invention relates to keyboards for electronic musical instruments, and more particularly to variable capacitors for such keyboards by which electrical signals are manifested in response to the amount of force with which keys are depressed.

2. The Prior Art

Numerous attempts to develop a keyboard for an electronic musical instrument have been made, with the provision of some means for differentiating between a strong and a light touch on the keyboard. For the most part these efforts have not been entirely satisfactory, however, either because of an inability to provide the correct feel for the operator or player of the keyboard or because the electrical signals which were produced were limited in their application. One example of the latter shortcoming is keyboards which produce signals in response to the amount of time required in the depression of the key from one point to another. While such keyboards produce signals which are proportional to the initial force, or velocity, with which the key is moved, they are not capable of providing a sustained electrical signal which continuously manifests the instantaneous force acting on an individual key.

Accordingly, it is desirable to produce a keyboard which is free of the limitations and drawbacks of the prior art.

SUMMARY OF THE INVENTION

A principal object of the present invention is to provide a keyboard for an electronic musical instrument having means for individually indicating the force with which keys of the keyboard are depressed, and for manifesting such indications continuously as long as such keys are depressed.

Another object of the present invention is to provide a simple and inexpensive arrangement for accomplishing the purposes of the present invention.

A further object of the present invention is to provide a keyboard with means for producing a force responsive signal which has an improved "feel" for the operator or player.

These and other objects and advantages of the present invention will become manifest by an examination of the following description and the accompanying drawings.

In one embodiment, a keyboard for an electronic musical instrument has a plurality of variable capacitors associated with the keys, one conductor of each capacitor being secured to an individual key, and movable with such key toward and away from the second conductor, in order to vary the capacitance of such capacitor in accordance with the amount of force with which the key is depressed. A spring normally maintains the conductors in separated condition.

BRIEF DESCRIPTION OF THE DRAWINGS

Reference will now be made to the accompanying drawings, in which:

FIG. 1 is a vertical cross sectional view showing a key having a variable capacitor and incorporating an illustrative embodiment of the present invention;

FIGS. 2*a*, 2*b* and 2*c* indicate the relationship of parts of the capacitor of FIG. 1 shown in three different stages of operation;

FIG. 3 illustrates a plan view of a module associated with a keyboard incorporating the present invention;

FIGS. 4*a* and 4*b* represent alternative shapes which may be employed for one conductor of the capacitor of the present invention; and FIGS. 5*a* and 5*b* illustrate graphs showing the response characteristic contained with the shapes of FIGS. 4*a* and 4*b*.

DESCRIPTION OF THE PREFERRED EMBODIMENT

Referring to FIG. 1, a key 10 is supported in relation to a fulcrum 12 for clockwise movement when the upper surface 14 of the key is depressed by an operator or player. Spring means 13 maintains the key 10 in the position illustrated in FIG. 1, against a stop 15, and returns the key to this position when the finger of the operator or player is released. Secured to the bottom surface of the key 10 is a support bar 16 which extends downwardly and at its lower end is connected to a shaped member 18 which forms an electrode (or conductor) of the variable capacitor. The member 18 is formed with a curved lower surface 20 which may be spherical, parabolic, elipsoidal, or the like. The curvature illustrated in FIG. 1 is convex. It may also be cylindrical, i.e. a curved surface which is the locus of parallel lines, which may in some cases be more economical to manufacture. The member 18 is preferably formed of an oxidizable metal, such as aluminum, the oxide of which is an insulator capable of acting as a capacitor dielectric. Chromium or titanium may also be used, for they also form relatively tough, insulating oxides.

The other conductor or electrode of the capacitor comprises a flexible conductive sheet 22, which is stretched over a support or bracket 24, which in turn is secured to a supporting wall 26. The support 24 is formed of insulating material such as plastic or the like and has a pair of studs 28 which are received in apertures in the wall 26 and staked over or deformed as shown in FIG. 1 so as to maintain the support 24 in place. The sheet 22, which is preferably formed of a conductive elastomer or the like, is provided with an aperture at each end, and the studs 28 pass through the aperture before passing through the apertures in the wall 26, and, in this way, hold the sheet 22 in position on the support 24. A body 30 of sponge rubber or the like is positioned within a hollow space inside the support 24 and underlies the lower surface of the sheet 22.

In operation, as the key 10 is rotated in a clockwise direction, the shaped member 18 descends toward the sheet 22 and engages a portion thereof, forcing it downwardly. The insulating oxide layer on the shaped member 18 insulates the member 18 from the sheet 22. The sponge rubber member 30 simultaneously pushes back up on the lower surface of the sheet 22, causing a portion of the sheet 22 to conform to the shape of the curved surface 20 of the member 18; i.e., about two orthogonal axes. The sponge rubber offers resistance to the downward movement of the key 10, and provides a "feel" by which the operator can judge the loudness or amplitude of the sound, by sensing the condition of the key.

As the key 10 is depressed further and further from its normal position, the sheet 22 is deformed more and more so as to conform to a larger area of the member 18, as shown in FIGS. 2*a*, *b*, and *c*, which illustrate successive positions occupied by the member 18 in relation to the sheet 22 as the key is depressed. An electrical conductor 32 is connected to the support bar 16 at one end and at the other end to a grounded terminal 34, to maintain the member 18 at a reference potential. The conductive sheet 22 is connected by means of a wire 36 to a circuit which modulates an output voltage in response to the instantaneous capacitance of the capacitor. It is apparent that as more surface area of the sheet 22 is caused to conform to the lower surface of the member 18, the capacitance extending between the wire 36 and ground is increased. As the key is released, the capacitance is decreased gradually as the member 18 moves out of contact with the sheet 22, and back to its home position.

Referring to FIGS. 4*a* and 4*b*, alternative shapes are illustrated for the member 18. The shape 18 shown in full line form in FIG. 4*b* corresponds generally to a spherical surface or other continuously curved surface, as shown in FIG. 1. The curve in FIG. 5*b* shown in full line illustrates the change in capacitance, as a result of movement of the member 18 relative to the sheet 22. If the bottom of the surface is flattened, as shown by dotted line 18' in FIG. 4*b*, the resulting characteristic is similar to that shown in FIG. 5*b*, in which there is a more abrupt change of capacitance at the time that the flattened portion engages the conductive sheet.

A modified irregular convex shape 18'' is shown in FIG. 4*a*, and its characteristic curve is shown in FIG. 5*a*, resulting in a sharp increase in capacitance at one position of the key, followed by a relatively flat curve, and then a gradual increase in capacitance. It is apparent that various modifications of the shape of the member 18 result in various characteristic curves and that the slope of a particular portion of the characteristic curve may be increased or decreased by making suitable modifications in the shape of the portion of the member 18 which just comes into contact at that position of the key 10.

The keyboard of a musical instrument incorporates a capacitor such as that shown in FIG. 1 for each key of the keyboard. In each case the member 18 is supported by an individual key, and the lower conductor of the capacitor, viz., the sheet 22, is mounted in fixed position supported by the frame of the instrument. FIG. 3 illustrates a plan view of an assembly incorporating the lower conductors of twelve successive capacitors, one for each note in a musical octave. A single support 24' is provided for all of the capacitors, which support is staked to a supporting plate 26, as illustrated in FIG. 3.

The supporting plate 26 preferably comprises an insulating sheet of material suitable for supporting printed circuit conductors, and a plurality of printed circuit conductors 42 connect the conductive sheets 22 of each of the several capacitors to individual pins of the connector 40. The sheets 22 are separated by gaps so that they remain out of electrical contact with each other. The connector 40 is preferably constructed in the standard 14 pin dual-in-line arrangement, so that the twelve capacitors may be readily connected to external circuitry by means of a standard 14 pin connector. Two connections are not used, although one of these two could be used for a ground connection if desired.

The arrangement of the present invention is very durable, as little stress is placed on any of the parts. All of the variable capacitors associated with the individual keys are highly uniform in their response characteristics. The construction shown provides considerable flexibility both in electrical and mechanical characteristics, by adjusting the shape of the member 18, and by adjusting the size and stiffness of the sponge rubber member 30.

While the present invention has been described in connection with an electronic musical instrument, those skilled in the art will appreciate that it may have other applications, wherever variable signals are desired in response to the force acting on a key. Other additions and modifications may be made in the present invention without departing from the essential features of novelty thereof, which are intended to be defined and secured by the appended claims.

What is claimed is:

1. For use with an electronic musical instrument having a keyboard for selecting sounds to be audibly produced, said keyboard having a plurality of pivotal keys, the combination comprising a variable capacitor associated with a key of said keyboard, said variable capacitor having a first conductor, and a second conductor in the form of a resilient conductive member, one of said conductors being shaped relative to the other so that relative movement of said conductors deforms said resilient member from its normal shape, and including a layer of insulation between said first and second conductors, one of said first and second conductors being fixed in position and the other being connected to said key, for movement relative to each other in response to operation of said key of said keyboard, for selectively varying the capacitance of said capacitor in accordance with the amount of movement of said key.

2. Apparatus according to claim 1, wherein said first conductor is secured to said key for movement therewith, and said second conductor is mounted in fixed relation to said keyboard in spaced relation to said first conductor.

3. Apparatus according to claim 1, wherein said second conductor is formed of a sheet of conductive elastomer, a portion of said conductive elastomer conforming to the shape of a portion of said first conductor as said key is depressed.

4. Apparatus according to claim 3, including resilient means engaging said conductive elastomer for urging said second conductor toward said first conductor.

5. Apparatus according to claim 1, including a plurality of said variable capacitors juxtaposed with said keyboard, one for each key thereof.

6. Apparatus according to claim 1, wherein said first conductor is formed of a metal having an insulating oxide, said layer of insulation being formed of said insulating oxide.

7. Apparatus according to claim 6, wherein said metal is selected from the group containing aluminum, titanium, and chromium.

8. Apparatus according to claim 1, including a plurality of variable capacitors each with an individual first conductor member, and means for connecting each of said variable capacitors individually with a key of said keyboard, whereby operation of said keys varies the capacitance of their respective capacitors.

9. Apparatus according to claim 1, wherein said first conductor has a convex shape.

10. Apparatus according to claim 1, wherein said first conductor is formed of solid non-resilient conducting material.

11. Apparatus according to claim 1, wherein said first conductor is formed with a spherical surface facing said second conductor.

12. Apparatus according to claim 1, wherein said first conductor is formed with an irregular convex surface facing said second conductor.

13. Apparatus according to claim 1, including means connecting one of said conductors to said key for causing said conductors to move toward each other in response to operation of said key.

14. Apparatus according to claim 1, wherein said other conductor is rigidly connected to said key and extends downwardly of said key, with said one conductor being rigidly supported in fixed position below said key.

15. Apparatus according to claim 1, wherein said first conductor is shaped in relation to said second conductor to provide a non-linear rate of change of capacitance relative to key movement.

16. Apparatus according to claim 1, wherein said other conductor is small in relation to said key.

17. Apparatus according to claim 1, wherein said resilient member is deformable by bending simultaneously about two orthogonal axes, to partially envelop a surface of said shaped conductor.

* * * * *